US011054119B2

(12) United States Patent
Wang et al.

(10) Patent No.: US 11,054,119 B2
(45) Date of Patent: Jul. 6, 2021

(54) LAMP FOR MOUNTING IN AN OPENING THROUGH A PLANAR SUBSTRATE, AND AN INSTALLATION METHOD

(71) Applicant: SIGNIFY HOLDING B.V., Eindhoven (NL)

(72) Inventors: Lijia Wang, Eindhoven (NL); Ying Xia, Eindhoven (NL); Jisong Xu, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/978,672

(22) PCT Filed: Mar. 4, 2019

(86) PCT No.: PCT/EP2019/055320
§ 371 (c)(1),
(2) Date: Sep. 4, 2020

(87) PCT Pub. No.: WO2019/174950
PCT Pub. Date: Sep. 19, 2019

(65) Prior Publication Data

US 2021/0003269 A1 Jan. 7, 2021

(30) Foreign Application Priority Data

May 9, 2018 (EP) ..... 18171511

(51) Int. Cl.
*F21V 21/04* (2006.01)
*F21V 15/01* (2006.01)
*F21Y 115/10* (2016.01)

(52) U.S. Cl.
CPC ..... *F21V 21/045* (2013.01); *F21V 15/01* (2013.01); *F21V 21/042* (2013.01); *F21Y 2115/10* (2016.08)

(58) Field of Classification Search
CPC ... F21S 8/026; F21V 21/04–046; F21V 15/01
See application file for complete search history.

(56) References Cited

U.S. PATENT DOCUMENTS 6,070,995 A 6/2000 Kanai
2012/0292458 A1 11/2012 Cheng
(Continued)

FOREIGN PATENT DOCUMENTS

AU 678037 B2 * 5/1997 ..... F21V 21/04
EP 1348903 A1 10/2003
(Continued)

*Primary Examiner* — Mariceli Santiago

(57) ABSTRACT

The invention provides a lamp (5) comprising a lamp body (6) and a mounting unit (8), for fitting through an opening in a substrate. The mounting unit has a front ring (10) for mounting against a front side of the substrate and an arrangement of lugs (12), sliders (20) and brackets (30). The brackets have a collapsed position in which the brackets fit through the opening; and an expanded locked position in which the brackets do not fit through the opening and the brackets are positioned for engaging with a back side of the substrate. The brackets are driven into their positions by a pushing/pulling arrangement rather than by using sprung arrangements. This enables damage to the substrate to be prevented.

15 Claims, 9 Drawing Sheets

(56) References Cited

U.S. PATENT DOCUMENTS

| | | | | |
|---|---|---|---|---|
| 2017/0198870 | A1* | 7/2017 | Wu | F21V 21/108 |
| 2018/0058629 | A1* | 3/2018 | Hart | E04B 9/006 |
| 2018/0063611 | A1* | 3/2018 | Hart | H04R 1/025 |

FOREIGN PATENT DOCUMENTS

| | | | | |
|---|---|---|---|---|
| EP | 1731830 | A1 | 12/2006 | |
| EP | 2944870 | A1 | 11/2015 | |
| EP | 3288280 | A1 | 2/2018 | |
| JP | 7296623 | A | 11/1995 | |
| JP | 2870636 | B1 * | 3/1999 | F21V 21/04 |
| WO | 2014183968 | A1 | 11/2014 | |

* cited by examiner

LAMP FOR MOUNTING IN AN OPENING THROUGH A PLANAR SUBSTRATE, AND AN INSTALLATION METHOD

CROSS-REFERENCE TO PRIOR APPLICATIONS

This application is the U.S. National Phase application under 35 U.S.C. § 371 of International Application No. PCT/EP2019/055320, filed on Mar. 4, 2019, which claims the benefit of International Application No. PCT/CN2018/079130, filed on Mar. 15, 2018 and European Patent Application No. 18171511.1, filed on May 9, 2018. These applications are hereby incorporated by reference herein.

FIELD OF THE INVENTION

This invention relates to lamps for mounting in an opening through a planar substrate, such as a ceiling panel.

BACKGROUND OF THE INVENTION

Recessed lighting, such as recessed spot lighting, is a very common form of interior lighting.

A lamp for providing recessed light typically comprises a lamp body (i.e. a bulb) and a mounting unit. The mounting unit is fitted through a hole in the substrate, and it also needs to be removable from that substrate for replacement or repair, without damaging the substrate.

The ability to insert and remove the mounting unit poses difficulties, particularly because the substrate is often a plasterboard sheet, which is easily damaged.

Existing mounting units for example make use of sprung arms which are held back by an installer against a torsional spring force, thereby to enable the mounting unit to be inserted. To remove the mounting unit, the sprung arms are automatically pulled back when pulling down on the mounting unit, by their engagement with the outer circumference of the opening.

This process applies stress along the edge and side surface of the opening in the substrate, such that the substrate e.g. ceiling may be damaged. It is also not an easy operation for the user.

There is therefore a need for a lamp design which can be inserted into an opening in a substrate (e.g. ceiling) to provide a recessed flush lighting solution, with a simple installation process, and preferably also a simple removal process, which does not damage the substrate.

SUMMARY OF THE INVENTION

The invention is defined by the claims.

According to examples in accordance with an aspect of the invention, there is provided a lamp suitable for mounting in an opening through a planar substrate, comprising a lamp body and a mounting unit, wherein the mounting unit comprises:

a front ring for mounting against a front side of the substrate;

at least two lugs protruding backwards from the front ring, wherein each lug has an end face which functions as a pusher;

a respective slider attached to each lug which is slideable along the respective lug, wherein the slider has a slider lip at one end for engaging with the front side of the substrate; and a respective bracket pivotally connected to another end of each slider opposite to the end with the slider lip;

wherein the mounting unit is configurable between two configurations:

a first configuration in which each slider lip is spaced from the front ring, the end face of the lug is spaced from the bracket, and the bracket is free to rotate to a collapsed position in which the brackets fit through the opening; and a second configuration in which each slider lip is against the front ring, the end face of the lug is against the bracket and the bracket is locked in an expanded position in which the brackets do not fit through the opening and the brackets are positioned for engaging with a back side of the substrate.

This lamp can be installed in a planar substrate, such as a ceiling, by a simple push fit. There is no need for torsional springs, and the retaining force is provided by the brackets, which themselves have a spring function. The brackets are initially free to rotate to their collapsed position so that they may easily be inserted through the opening, with no need for a user to apply a force against a torsional spring as in some known mounting unit designs.

After initial insertion, the sliding between the lugs and sliders by continued pushing of the lamp starts to engage the brackets and rotate them into an expanded position. During this time, the slider is stationary because the lip has engaged with the front side of the substrate. The brackets are rotated until they reach their expanded position and then push against the back side of the substrate. There is no need for the user to have any access to the back side, and the insertion is a simple push operation. It can even be carried out with a lamp body mounted in the mounting unit. Thus, the lamp body and the mounting unit thus preferably fit through the opening when the mounting unit is in the first configuration.

The lamp body is typically an enclosure in which an LED driver and LED arrangement are contained, i.e. an LED bulb.

The installation (and also removal) may be performed with no tools.

Note that the term "front" is used to denote a side facing the intended light output and "back" is the opposite side. Similarly, "backwards" is intended to mean a direction opposite to the intended light output direction, and hence in a direction into the ceiling or other substrate which is to carry the lamp.

It is noted that the brackets are considered to fit through the opening if they can pass through the opening at the same time, i.e. together as a set extending from the front ring. Each bracket individually has a shape which fits through the opening, but whether or not they can fit through as a set (i.e. whether or not the whole lamp can be pushed or pulled through the opening) depends on their collapsed or expanded state.

By way of example, one of the slider and lug comprises a slot and the other of the slider and lug comprises a pin. The slot and pin define the required range of sliding movement which in turn causes rotation of the bracket.

Each lug preferably has a lug opening and the bracket has a hook, wherein the hook is received in the lug opening in the second configuration.

The hook is used to provide a locking function when in the expanded position of the brackets. The brackets rotate until this hook engages. It provides a lock to the sliding function so that mounting unit function as a rigid one-piece unit.

Each bracket may comprise a bent strip, wherein the hook comprises a projecting elbow. This provides a simple hook design which is just a shape feature of the bracket.

The bent strip for example comprises a first limb having the hook, a second limb longer than the first limb, and a U-bend between the two limbs. The two limbs and the hook perform different functions so that the overall functionality is achieved with a small number of low cost components.

Each bracket for example comprises a first end portion which extends from the hook, wherein the first end portion functions as a puller for pulling the hook out of the lug opening.

This first end portion can thus be used to release the hook. This is achieved by pulling on the mounting unit. This pulling force against the first end portion for example translates to a lateral force which enables the hook to be pulled out from the lug opening.

The first end portion presses against a back side of the substrate to perform the releasing function. The brackets can then freely rotate. Thus, removing the mounting unit is also a simple pull operation, and there is no need for access to the back side of the substrate, nor is there any need to hold back any springs. This avoids damage to the substrate during removal.

The first limb may comprise one or more openings, slots or recesses to reduce the rigidity of the first limb compared to the second limb. This reduced rigidity helps to ensure the hook release function is correctly achieved.

Each bracket for example comprises a second end portion, wherein the second end portion is for pressing against a back side of the substrate when in the expanded position.

This second end of the bracket provides the engagement with the planar substrate to hold the lamp in place. Thus, the planar substrate is clamped between the front ring (and slider lip) and the send end portions of the brackets.

There may be exactly two lugs and associated sliders and brackets.

The lamp is for example a ceiling downlight.

The invention also provides a mounted lamp assembly, comprising:

a planar substrate; and the lamp as defined above mounted in an opening in the planar substrate, wherein the mounting unit is in the second configuration, and wherein the front ring is against a front side of the substrate, and each slider lip is pressed against the front ring by the front side of the substrate.

The planar substrate for example comprises a ceiling.

The invention also provides a method of mounting a lamp as defined above in an opening through a planar substrate, comprising:

setting the mounting unit in the first configuration with the brackets of the lamp collapsed;

positioning the front ring against a front side of the substrate, such that the lugs project through the opening;

advancing the mounting unit such that the slider slides until the slider lip engages with the front side of the substrate; and further advancing the front ring of the mounting unit such that the end face of each lug performs a pushing function against a respective bracket until the front ring reaches the slider lip, wherein when the front ring reaches the slider lip, the mounting unit is in the second configuration.

This is the insertion process using the mounting unit defined above, which can be a simple push fit operation.

During the further advancing, the end face preferably rotates the bracket until a hook of the bracket is received in an opening in the lug. This provides a locking function.

The method may further comprise removing the lamp from the opening, by:

pulling the front ring away from the front side of the substrate until a first end portion of each bracket, which extends from the hook, contacts the back side of the substrate;

further pulling the front ring away from the front side of the substrate, causing the first end portion to pull the hook out of the lug opening and thereby release the brackets for rotation; and further pulling the front ring away from the front side, causing the brackets to rotate to the collapsed position and allow the lamp to be removed.

This is the removal process using the lamp defined above, which can be a simple pull out operation These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

Figure 1:
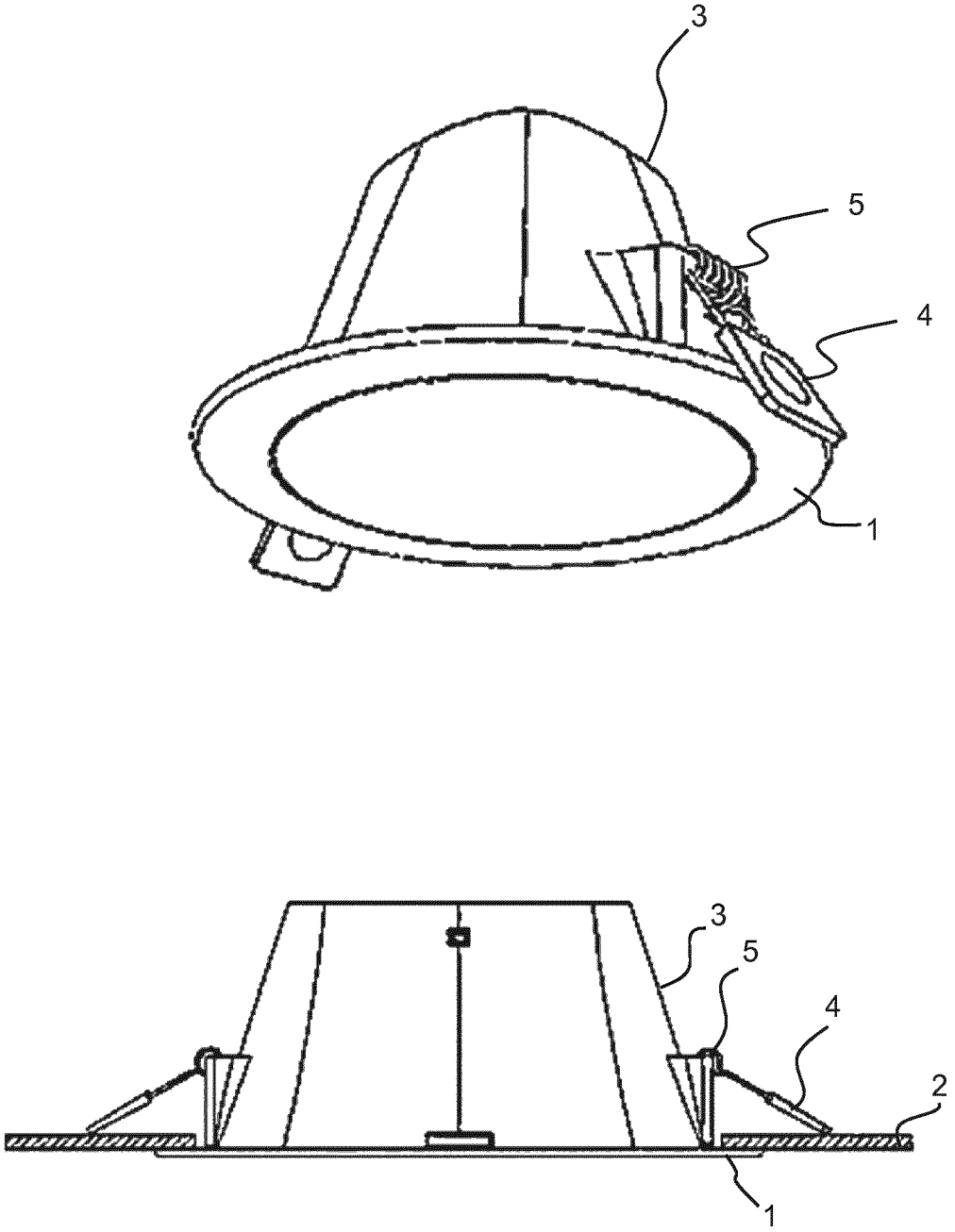
FIG. 1 shows a known design of a mounting unit for receiving a lamp.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a lamp comprising a lamp body and a mounting unit, for fitting through an opening in a substrate. The mounting unit has a front ring for mounting against a front side of the substrate and an arrangement of lugs, sliders and brackets. The brackets have a collapsed position in which the brackets fit through the opening, and an expanded locked position in which the brackets do not fit through the opening and the brackets are positioned for engaging with a back side of the substrate. The brackets are driven into their positions by a pushing/pulling arrangement rather than by using sprung arrangements. This enables damage to the substrate to be prevented.

FIG. 1 shows a known design of a mounting unit for receiving a bulb. The mounting unit comprises a front ring 1 for positioning flush against a surface of a substrate 2 such as a ceiling. Behind the front ring 1 there is a main body 3 which projects through an opening in the substrate 2. The front ring is larger than the opening and provides a neat finish. The main body 3 receives a bulb.

There are two sprung arms 4 at diametrically opposite positions, which are biased by torsion springs 5 to rotate downwardly.

Figure 2:
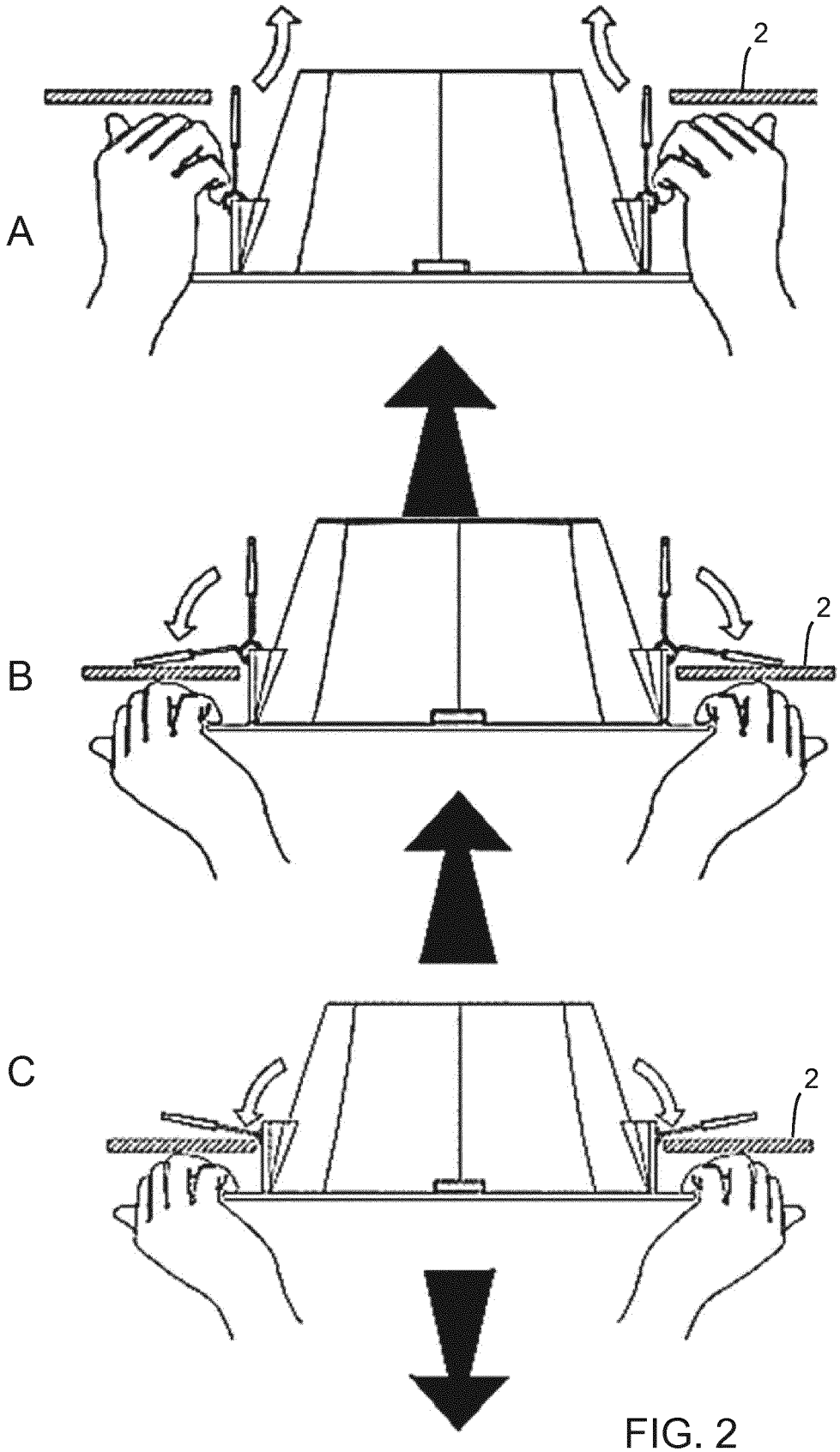
FIG. 2 shows how to install and remove the mounting unit of FIG. 1.

FIG. 2 shows how to install and remove the mounting unit of FIG. 1.

To insert the mounting unit, the sprung arms are held back by a user against the spring bias so that the arms may fit through the opening, as shown in the top image of FIG. 2. Once released, they rotate (downwardly) to push down on the back face of the substrate 2 as shown in the middle image of FIG. 2. This tends to lift the main body up and maintain the front ring 1 against the front face of the substrate 2.

To remove the mounting unit, the user has to pull down on the front ring 1 against the bias of the sprung arms as shown in the bottom image of FIG. 2. During removal, the arms (and the torsion spring) will push against the surface at the inner wall of the opening and the top edge of the opening, and this may cause damage.

Furthermore, the strength of the torsional springs 5 depends on the weight of the mounting unit and lamp, and it may create a force which is a danger to the user during the installation or removal, or at least it may be difficult for the user to perform these tasks.

Figure 3:
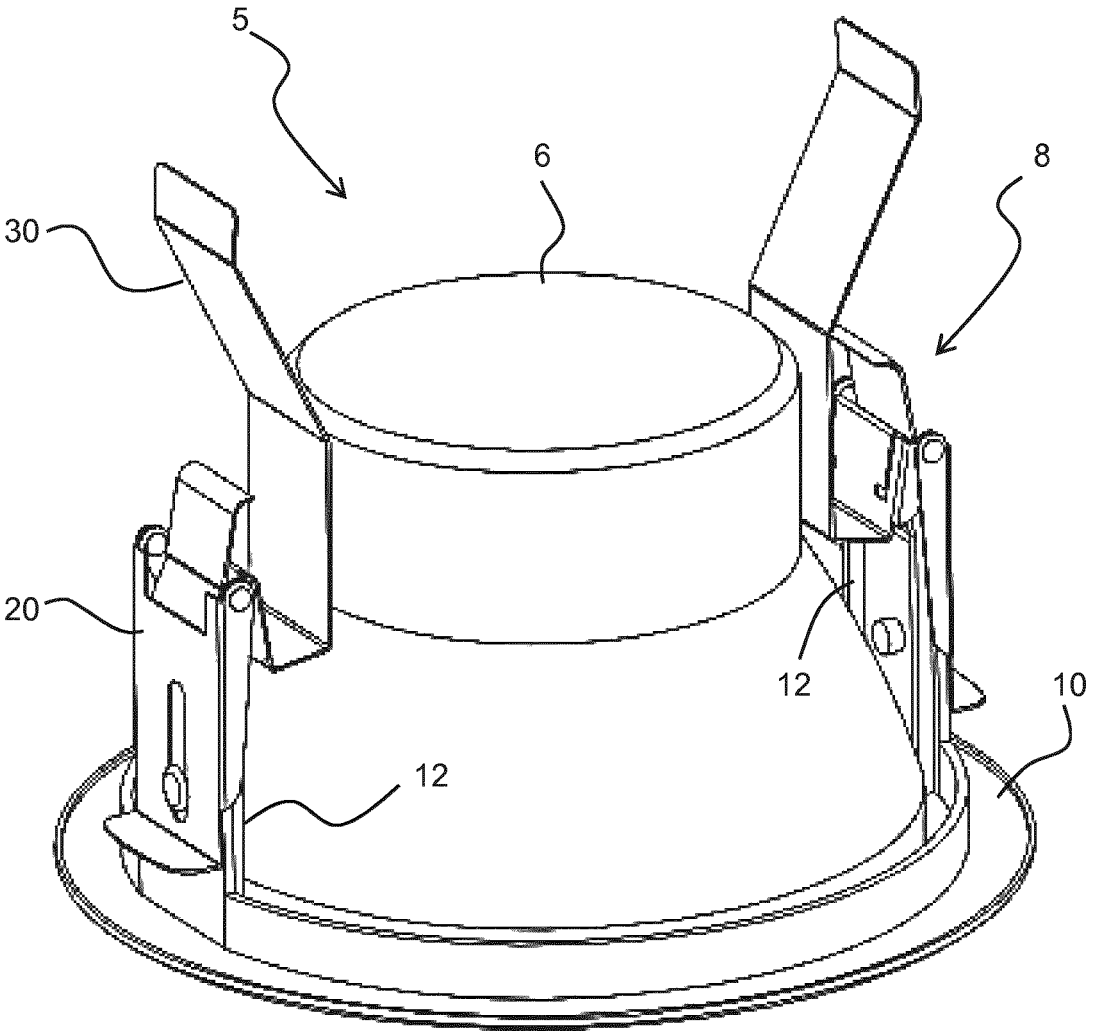
FIG. 3 shows a lamp in accordance with one example of the invention, comprising a lamp body and a mounting unit.

FIG. 3 shows a lamp 5 in accordance with one example of the invention, comprising a lamp body 6 (such as an LED bulb which comprises an LED arrangement and associated driver) and a mounting unit 8. The term "lamp" is thus used in this text to denote the combination of the lamp body and the mounting unit.

The mounting unit 8 has a front ring 10 for mounting against a front side of the substrate through which the lamp is to be installed. As with the example of FIGS. 1 and 2, the front ring is larger than the opening so that it provides a neat and near flush closure to the opening. The front ring 10 also functions as a support for the lamp body 6.

At least two lugs 12 protrude backwardly (i.e. generally in the direction towards the back of the substrate) from the front ring 10. They for example project perpendicularly from the front ring.

There is a bracket 30 at the end of each lug. The brackets rotate between a collapsed configuration as shown in FIG. 3 in which the whole lamp can pass through the opening (apart from the front ring) and an extended configuration in which the lamp is held in place. The movement of the brackets between these configurations is controlled by sliders 20. The sliders each slide up and down a respective lug. The detailed functionality of these various components is described further below. First, the features of the components is described in more detail.

Figure 4:
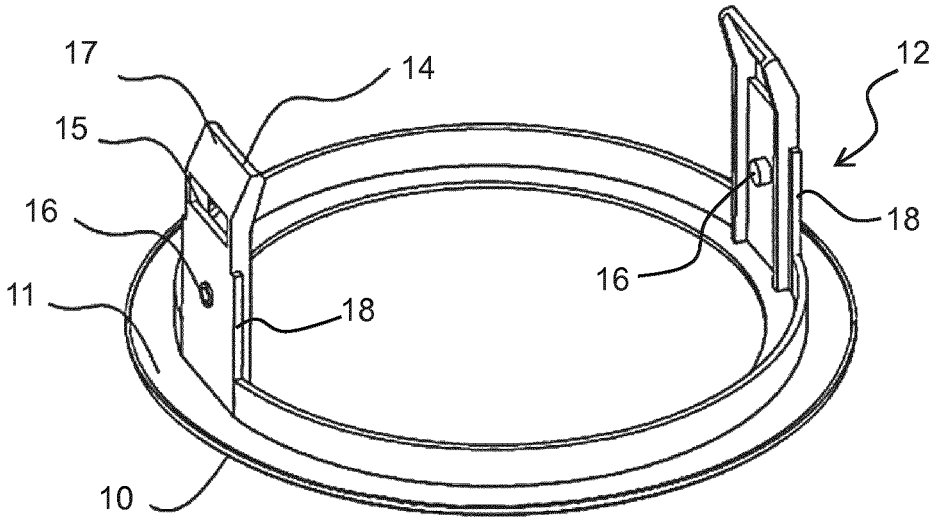
FIG. 4 shows the front ring and the lugs of the lamp of FIG. 3 in more detail.
Figure 5:
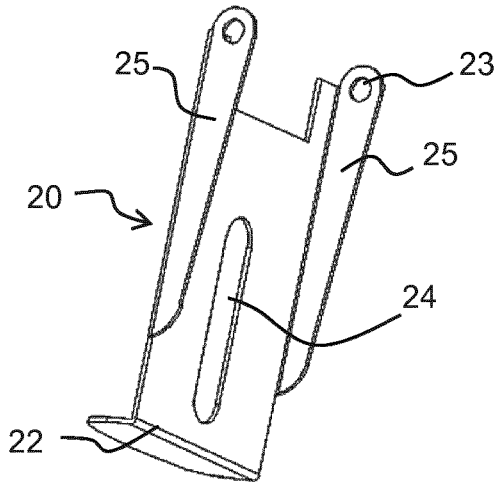
FIG. 5 shows the slider of the lamp of FIG. 3 in more detail.
Figure 6:
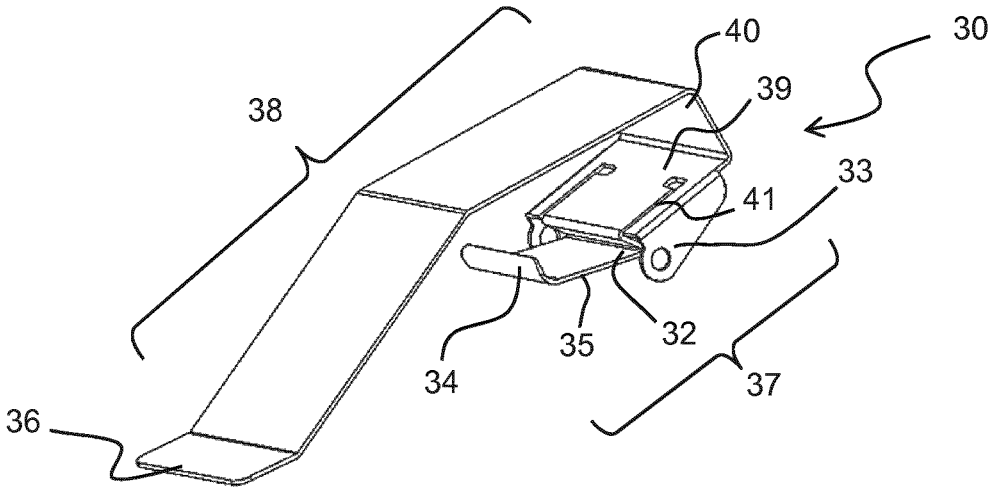
FIG. 6 shows the bracket of the lamp of FIG. 3 in more detail.

FIG. 4 shows the front ring 10 and the lugs 12 in more detail, FIG. 5 shows one of the sliders in more detail and FIG. 6 shows one of the brackets in more detail.

As shown in FIG. 4, the lugs protrude from a back face 11 of the front ring 10. Each lug 12 has an end face 14 (remote from the front ring) which functions as a pusher for pushing the brackets. A pin 16 is used to control the range of movement of the slider 20 up and down the lug 12. The lug has a slope face 17 just back from the end face 14.

As shown in FIG. 5, each slider 20 has a slider lip 22 at one end for engaging with the front side of the substrate and a pivot mounting point 23 at the other end. The pivot mountings comprise openings provided in side faces 25. These side faces 25 engage with side edges 18 of the lug 12 to facilitate a sliding rail arrangement. A slot 24 engages with the pin 16 to define the range of sliding movement. Of course, the pin and slot may be the other way around, or any other way of controlling a range of possible sliding movement may be used.

A respective bracket 30 is pivotally connected to the pivot mounting point 23 at the end of each slider 20, opposite to the end with the slider lip 22.

As shown in FIG. 6, the bracket comprises a bent strip. The bent strip comprises a first limb 37, a second limb 38 longer than the first limb, and a U-bend 40 between the two limbs.

The first limb 37 has a hook 32 which functions as a lock to hold the lamp in place once installed. It is in the form of a projecting elbow along the bracket. The first limb also has a mounting part 33 where it connects to the mounting point 23 of the slider, for free rotation, i.e. with no torsional spring needed.

A first end portion 34 of the bracket, at the remote end of the first limb 37, extends from the hook 32. This end portion functions as a puller for releasing the locking function of the hook. A second end portion 36 of the bracket, at the remote end of the second limb 38, is for pressing against a back side of the substrate when in the expanded position.

Between the hook 32 and the U-bend 40 is a segment 39. In the example shown, this segment 39 has two slots 41. These reduce the rigidity of the first limb 37. As the limb 37 is very short, it may be desired to reduce the rigidity to ensure that the function of releasing the hook 32 can be achieved. The first limb may more generally comprise one or more openings, slots or recesses to reduce the rigidity of the first limb compared to the second limb.

The engagement point of the end surface 14 of the lug 12 and the first limb 37 (which is used to cause rotation of the bracket) is designed to be offset from the axis through the pivot mounting points 23, to allow sufficient torque for rotating the bracket 30. The engagement force on the end surface 14 does therefore not pass through pivot mounting axis.

The hook 32 is designed to engage with a lug opening 15 (shown in FIG. 4) to lock the lamp into position. This engagement means the slider is no longer able to slide relative to the lug, and it thus locks the mounting unit.

The mounting unit is adjustable between two configurations.

Figure 7:
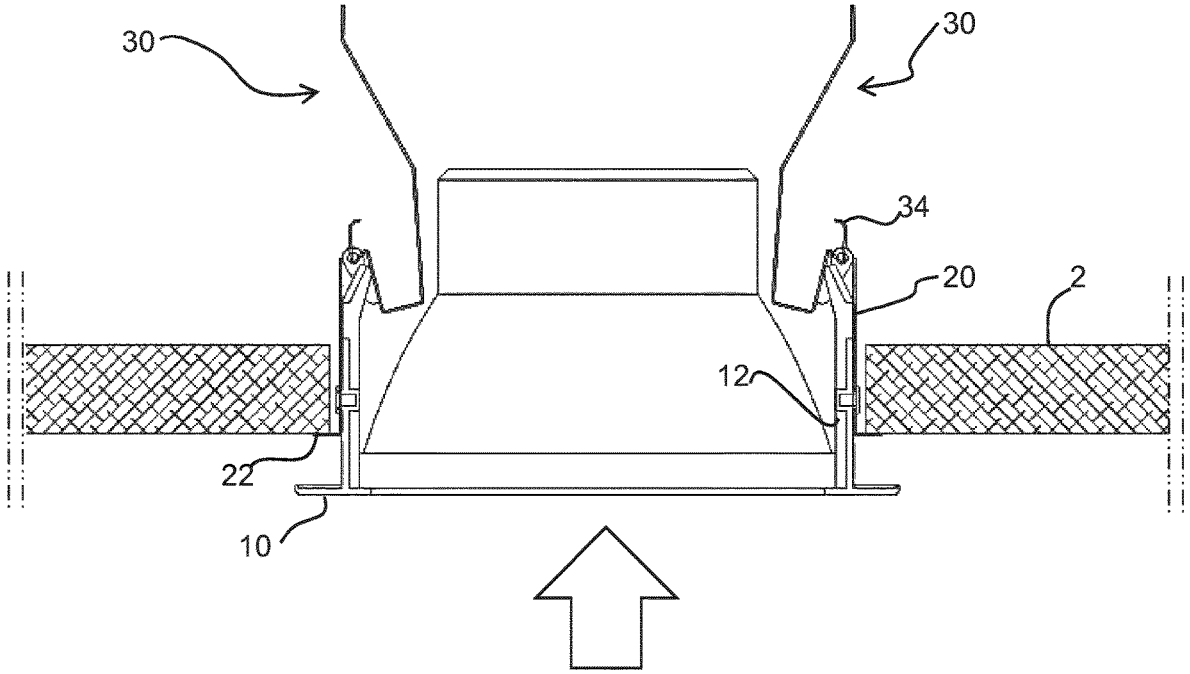
FIG. 7 shows a first configuration for the lamp of FIG. 3.

A first configuration is shown in FIG. 7, which is for inserting the lamp through the opening in the substrate 2.

Each slider lip 22 is spaced from the front ring 10. This means the slider is slid back as far as possible (i.e. as far up as possible in the orientation of FIG. 7) so that the brackets (which are connected to the ends of the sliders) are pushed away from the end face 14 of the lug 12. The brackets are thus free to rotate to the collapsed position shown in which the brackets fit through the opening. This does not need the user to hold back any spring force, and the lamp can easily be inserted through the opening.

By continuing to push on the front ring 10, rotation of the brackets is performed to result in a second configuration in which the lamp is locked in place.

Figure 8:
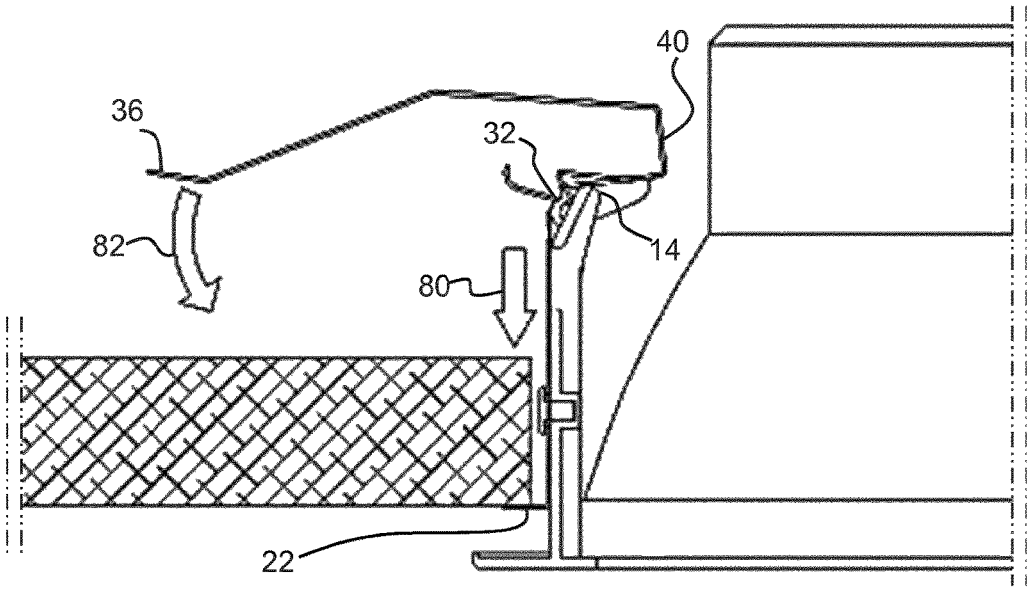
FIG. 8 shows the initial transition toward a second configuration for the lamp of FIG. 3.

FIG. 8 shows the initial transition toward this second configuration, namely mid-way between the two configurations.

The gap between the slider lip 22 and the front ring is being closed, because the front ring is being advanced whereas the slider lip is held in position by the front surface of the substrate 2. As a result, the bracket is effectively pulled down (arrow 80) onto the end faces 14 of the lugs 12. The end faces push the brackets to cause rotation as shown in FIG. 8 (arrow 82).

Figure 9:
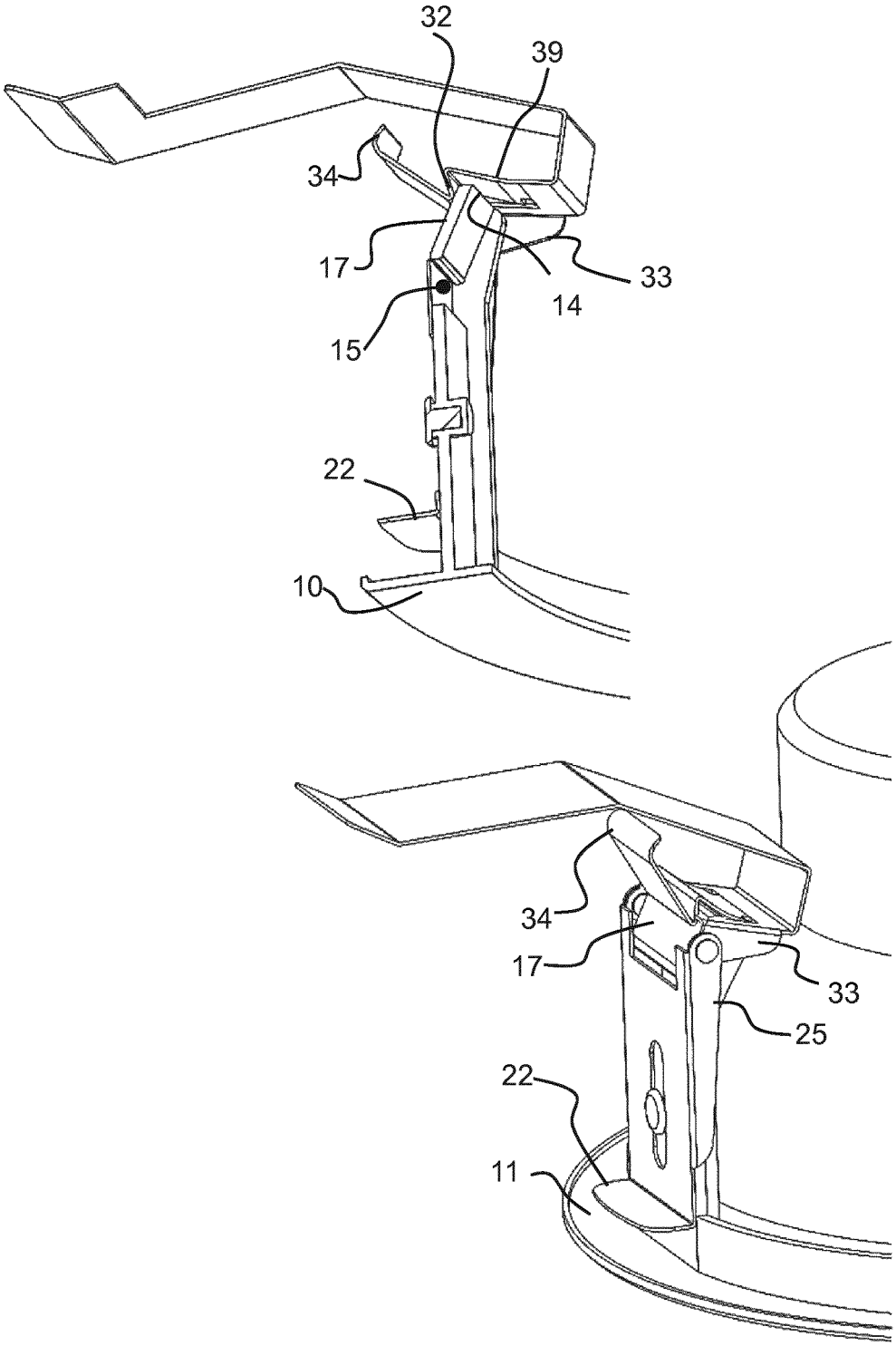
FIG. 9 shows the engagement between the end face of one lug and the bracket in more detail in the configuration of FIG. 8.

FIG. 9 shows the engagement between the end face 14 of one lug and the bracket in more detail in this intermediate position. Two views are shown in FIG. 9. A first is a perspective view with the lug, slider and bracket in cross section, and a second is a full perspective view. They show that the pin and slot arrangement is half way along its range of movement, and the bracket is approximately half way rotated. The end face 14 pushes against the segment 39.

The hook 32 is sliding down the slope face 17 of the lug.

Figure 10:
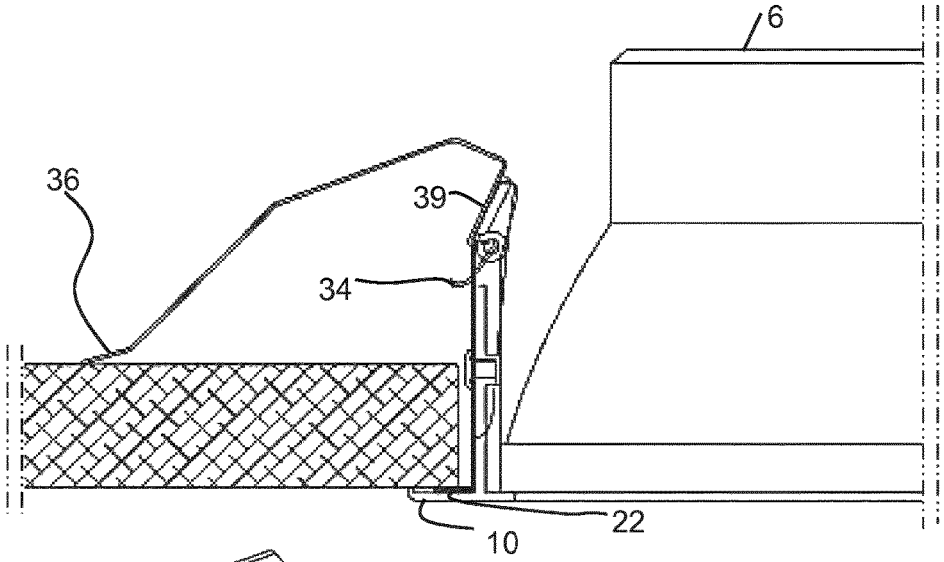
FIG. 10 shows a second configuration for the lamp of FIG. 3.

FIG. 10 shows the final second configuration for one bracket. The slider lip 22 is against the front ring 10 (i.e. the gap has been closed), the end face 14 of the lug 12 is against the bracket, and the bracket is locked in an expanded position in which the brackets as a set do not fit through the opening.

The segment 39 is against the slope face 17 of the lug. The hook 32 has slid down the slope face and has engaged with the opening 15 in the lug and thus locks the bracket in place. The bracket, in particular the second end portion 36, engages with a back side of the substrate 2.

The hook prevents relative sliding between the slider and front ring, so that the lamp behaves as a single rigid unit. The locked unit is biased upwardly by the general spring force of the brackets themselves.

The elasticity of the brackets, especially the longer second limb 38, allows a tolerance of ceiling thickness, for example 2 mm to 25 mm.

Figure 11:
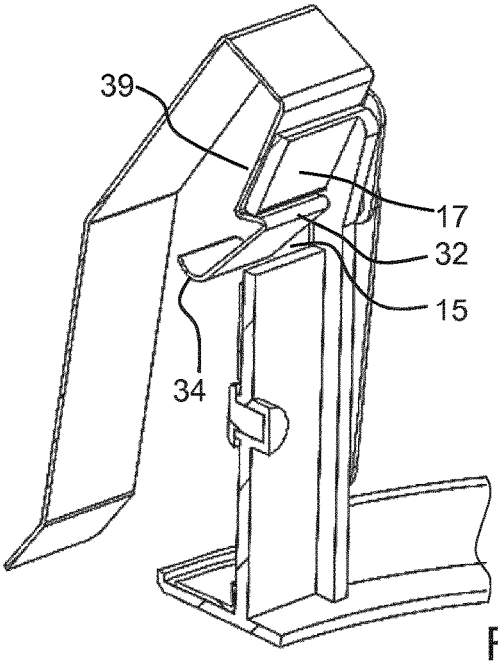
FIG. 11 shows the engagement between the end face of one lug and the bracket in more detail in this the configuration of FIG. 10.

FIG. 11 shows the engagement between the end face 14 of one lug and the bracket in more detail in this final installed position. The pin and slot arrangement is at the end of its range of movement, and the bracket is fully rotated. The segment 39 sits on the slope face 17 and the hook is caught in the lug opening 15.

Figure 12:
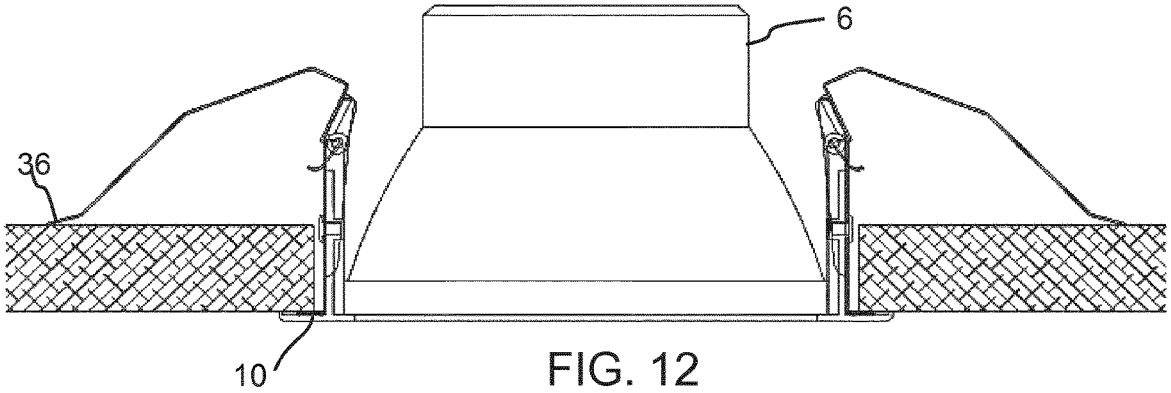
FIG. 12 shows the full lamp in the second configuration.

FIG. 12 shows the full lamp in the second configuration. The planar substrate 2 is clamped between the front ring 10 (and lip) and the send end portions 36 of the brackets.

The lamp can thus be installed in a planar substrate, such as a ceiling, by a simple push fit. There is no need for torsional springs, and the retaining force is provided by the brackets, which themselves have a spring function, as well as the hook locking function. There is no need for the user to have any access to the back side of the substrate, and the insertion is a simple push operation. It can even be carried out with a lamp body mounted in the mounting unit.

The removal process is also simplified, and is explained with reference to FIGS. 13 to 15.

Figure 13:
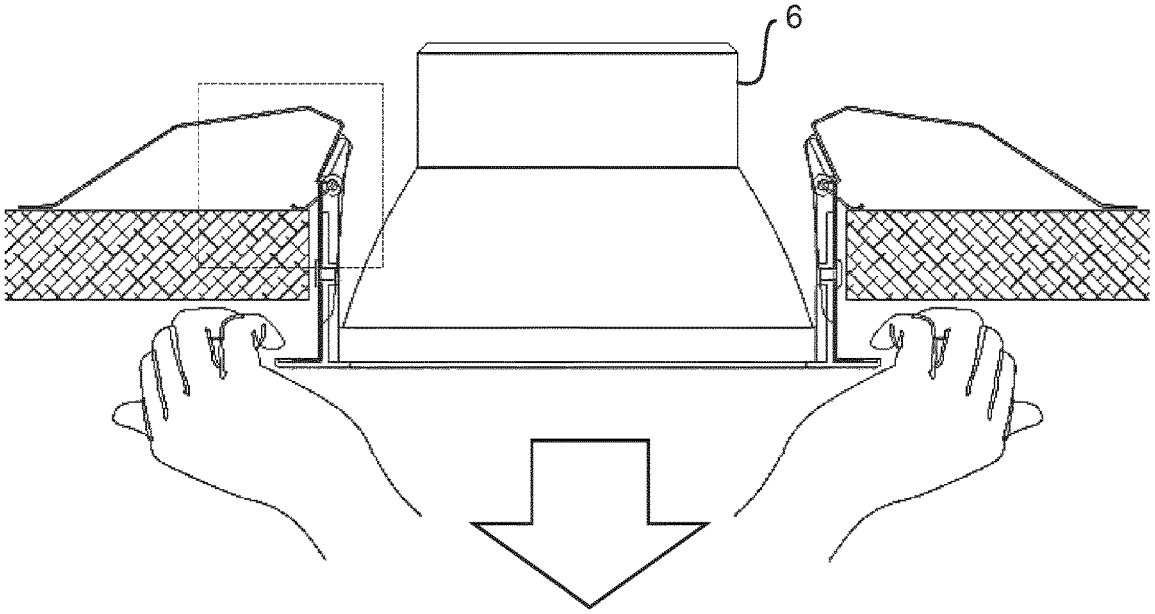
FIG. 13 shows an initial stage for removing the lamp of FIG. 3.

FIG. 13 shows the initial stage of the removal process. The front ring is pulled down. The slider remains locked by the hook, so the lamp moves down as a unit against the return force of the second limbs 38, causing the second limbs 38 to deform.

The first end portion 34 then engages with the back surface of the substrate. This engagement is used to release the hook. Thus, by pulling on the mounting unit further, the locking of the hook is released. It is pulled out of the opening 15.

This enables the slider to move so that the brackets can then freely rotate.

Figure 14:
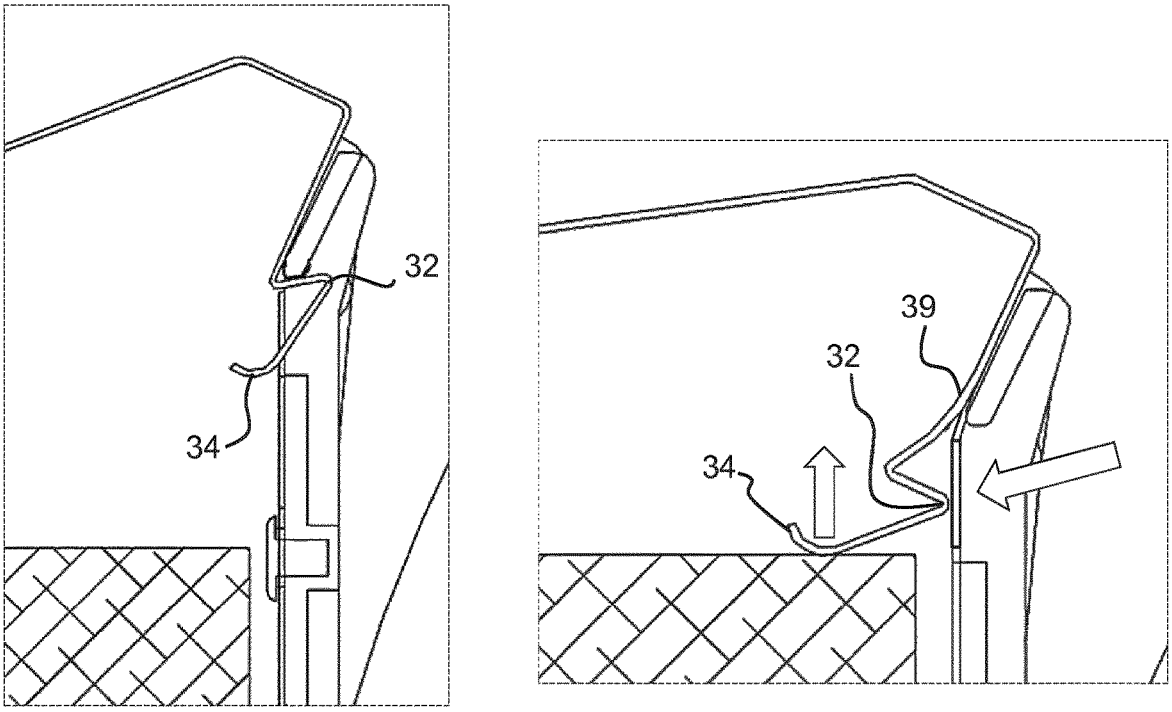
FIG. 14 shows the release of the hook in more detail.

FIG. 14 shows this hook release more clearly with enlarged views for the dash-lined area in FIG. 13. The left image shows that before the first end portion 34 reaches the substrate, the slider does not slide down because it is fixed to the bracket, and the bracket is pulling up (by its spring bias) on the lug by means of the hook. The right image shows that when the first end portion 34 is pushed up (as shown by the upward arrow), the bracket bends in the region of the segment 39 which results in lateral movement of the hook 32 out of the opening in the lug.

Figure 15:
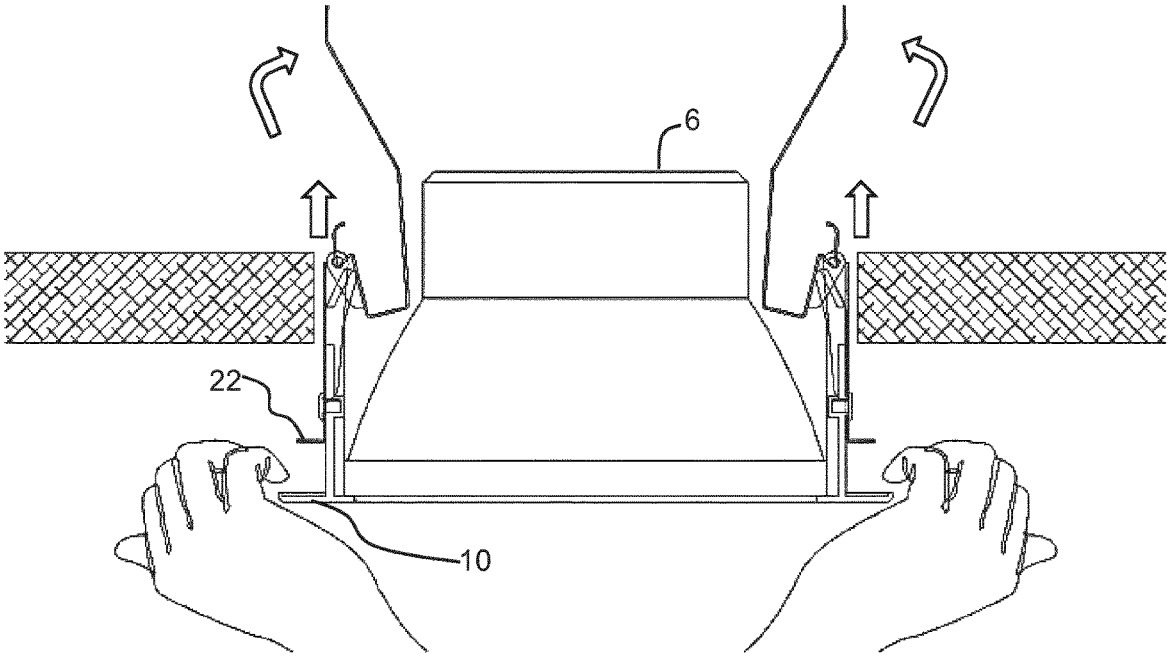
FIG. 15 shows the final stage for removing the lamp.

FIG. 15 shows further movement of the lamp after the hook has been released. The gap between the slider lip and the front ring has opened up and the brackets are free to rotate. Because they are not rotationally spring biased, they can easily be pushed into the collapsed configuration shown in FIG. 14, for example by the substrate engaging with the first end portions or with the second limbs 38. The small force needed to rotate the brackets does not damage the substrate.

Thus, removing the mounting unit is also a simple pull operation, and there is no need for access to the back side of the substrate, nor is there any need to hold back any springs. This avoids damage to the planar substrate during removal.

The example above shows two lugs and associated sliders and brackets, but there may be three or even more, for example as a function of the weight of the lamp. The invention is of particular interest for ceiling downlights.

The lamp may be sold with the lamp body and mounting unit as an integrated unit, which is to be changed as a single item. Alternatively and more typically, the mounting unit may be separate from the lamp body. It may then for example comprise a clip or other attachment feature to enable the mounting unit to be attached to the lamp body. As a further alternative, the lamp body may simply sit on the front ring under its own weight. The back surface 11 of the front ring then comprises a supporting flange on which the lamp body can rest.

The invention may be applied to LED bulbs but equally to any other type of bulb.

The simplified design of the mounting unit and the reduced risk of damage to the substrate means it can be removed from the substrate multiple times, e.g. each time a bulb is to be replaced. This means that the connection between the bulb and the mounting unit can be simplified, giving a more compact and aesthetically pleasing design. Thus, instead of removing bulb from a fixed mounting unit so that mounting unit stays attached to the substrate, the whole lamp can be removed for replacement of the lamp body, replacement of a driver, or maintenance/replacement of the whole lamp.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lamp suitable for mounting in an opening through a planar substrate, comprising a lamp body and a mounting unit; wherein the mounting unit comprises:

a front ring for mounting against a front side of the substrate;

at least two lugs protruding backwards from the front ring, wherein each lug has an end face which functions as a pusher;

a respective slider attached to each lug which is slideable along the respective lug, wherein the slider has a slider lip at one end; and a respective bracket pivotally connected to another end of each slider opposite to the end with the slider lip;

wherein the mounting unit is configurable between two configurations:

a first configuration in which each slider lip is spaced from the front ring, the end face of the lug is spaced from the bracket, and the bracket is free to rotate to a collapsed position in which the brackets fit through the opening; and a second configuration in which each slider lip is against the front ring for engaging with the front side of the substrate, the end face of the lug is against the bracket and the bracket is locked in an expanded position in which the brackets do not fit through the opening and the brackets are positioned for engaging with a back side of the substrate.

2. A lamp as claimed in claim 1, wherein one of the slider and lug comprises a slot and the other of the slider and lug comprises a pin.

3. A lamp as claimed in claim 1, wherein each lug has a lug opening and the bracket has a hook, wherein the hook is received in the lug opening in the second configuration.

4. A lamp as claimed in claim 3, wherein the bracket comprises a bent strip, wherein the hook comprises a projecting elbow.

5. A lamp as claimed in claim 4, wherein the bent strip comprises a first limb having the hook, a second limb longer than the first limb, and a U-bend between the two limbs.

6. A lamp as claimed in claim 5, wherein the first limb comprises one or more openings, slots or recesses to reduce the rigidity of the first limb compared to the second limb.

7. A lamp as claimed in claim 4, wherein the bracket comprises a first end portion which extends from the hook, wherein the first end portion functions as a puller for pulling the hook out of the lug opening.

8. A lamp as claimed in claim 7, wherein the bracket comprises a second end portion, wherein the second end portion is for pressing against a back side of the substrate when in the expanded position.

9. A lamp as claimed in claim 1, comprising exactly two lugs and associated sliders and brackets.

10. A lamp as claimed in claim 1, comprising a ceiling downlight lamp.

11. A mounted lamp assembly, comprising:

a planar substrate; and the lamp as claimed in claim 1 mounted in an opening in the planar substrate, wherein the mounting unit is in the second configuration, and wherein the front ring is against a front side of the substrate, and each slider lip is pressed against the front ring by the front side of the substrate.

12. A mounted lamp assembly as claimed in claim 11, wherein the planar substrate comprises a ceiling.

13. A method of mounting a lamp as claimed in claim 1 in an opening through a planar substrate, comprising:

setting the mounting unit in the first configuration with the brackets of the lamp collapsed;

positioning the front ring against a front side of the substrate, such that the lugs project through the opening;

advancing the mounting unit such that the slider slides until the slider lip engages with the front side of the substrate; and further advancing the front ring of the mounting unit such that the end face of each lug performs a pushing function against a respective bracket until the front ring reaches the slider lip, wherein when the front ring reaches the slider lip, the mounting unit is in the second configuration.

14. A method as claimed in claim 13, comprising, during the further advancing, the end face rotates the bracket until a hook of the bracket is received in an opening in the lug.

15. A method as claimed in claim 14, further comprising removing the lamp from the opening, by:

pulling the front ring away from the front side of the substrate until a first end portion of each bracket, which extends from the hook, contacts the back side of the substrate;

further pulling the front ring away from the front side of the substrate, causing the first end portion to pull the hook out of the lug opening and thereby release the brackets for rotation; and further pulling the front ring away from the front side, causing the brackets to rotate to the collapsed position and allow the lamp to be removed.

* * * * *